United States Patent [19]

Taira et al.

[11] 4,373,365

[45] Feb. 15, 1983

[54] UP-SET SHRINKER FOR PRODUCING THICK WALL STEEL PIPE

[75] Inventors: Tadaaki Taira; Toshio Ishihara; Junichiro Takehara, all of Fukuyama, Japan

[73] Assignee: Nippon Kokan Kabushiki Kaisha, Tokyo, Japan

[21] Appl. No.: 151,470

[22] Filed: May 19, 1980

[30] Foreign Application Priority Data

May 22, 1979 [JP] Japan ..... 54-62245

[51] Int. Cl.[3] ..... B21D 5/10

[52] U.S. Cl. ..... 72/52; 228/151

[58] Field of Search ..... 72/51, 52, 176, 177, 72/178, 179, 181, 368, 402; 228/146, 147, 149, 151, 173 B

[56] References Cited

U.S. PATENT DOCUMENTS

| | | | |
|---|---|---|---|
| 539,297 | 5/1895 | Plecker | 72/52 |
| 1,816,534 | 7/1931 | Hume | 228/151 |
| 3,977,065 | 8/1976 | Johnson | 72/402 X |
| 4,122,696 | 10/1978 | Midzutani et al. | 72/52 |

FOREIGN PATENT DOCUMENTS

| | | | |
|---|---|---|---|
| 538995 | 11/1931 | Fed. Rep. of Germany | 72/178 |
| 831534 | 2/1952 | Fed. Rep. of Germany | 72/52 |
| 197706 | 6/1977 | U.S.S.R. | 72/52 |

OTHER PUBLICATIONS

The Uncommon Approach to Metalforming; Grotnes Machine Works, Inc., 1970.

*Primary Examiner*—Ervin M. Combs

*Attorney, Agent, or Firm*—Frishauf, Holtz, Goodman & Woodward

[57] ABSTRACT

For producing steel pipe from thick steel plate, an up-set shrinker is employed for reducing and processing an O-shaped pipe-blank in a facility for producing thick wall steel pipe. The up-set shrinker is provided with a plurality of reducing shrinker dies located around the pipe-blank in correspondence to parts other than abutting parts of the edges of the pipe-blank, and with at least one edge processing shrinker die located in correspondence to the butting parts of the edges of the pipe-blank. The edge processing shrinker die is formed at its die surface with a projecting portion over the length of the die. The edge processing shrinker die is actuated independently of the reducing shrinker dies.

7 Claims, 12 Drawing Figures

UP-SET SHRINKER FOR PRODUCING THICK WALL STEEL PIPE

BACKGROUND OF THE INVENTION

The invention relates to an up-set shrinker for reducing and processing an O-shaped pipe-blank in production of steel pipe, particularly thick steel pipe in which the ratio of thickness/outer diameter of the pipe is greater than 2%.

The UOE process is known as one process for producing thick welded steel pipes. This in general comprises, (i) carrying out edge preparation on the steel plate,
(ii) performing an edge-bending process on the edges of the plate, by means of a crimping press,
(iii) forming the plate into U-shape through an U-ing process,
(iv) performing an O-ing process on the U-shaped pipe-blank,
(v) subjecting the O-shaped pipe-blank to tack welding at butted edges,
(vi) subjecting the tack welded pipe to an inner surface welding and an outer surface welding, and
(vii) expanding the pipe by means of for example, a mechanical expander.

The UOE process has been employed in the production of steel pipe of large diameter due to its characteristics. However, a thick wall and high strength are required for deep-sea pipeline or structural steel pipe, and a big problem occurs in the UOE process in producing thick wall steel pipe of large diameter which is more than 2% in thickness/outer diameter. More particularly, peaking is inevitably caused.

The term "peaking" means a deviation of the butted edge from the outer diameter, i.e., a degree defined by delta in FIG. 1 (projecting from the regular circle Q). The peaking creates inconveniences such as instability at welding after the O-ing which causes defects in the weld. Further, the peaking remaining after the weld generates large angular distortion on the seam part during the expansion process and may bring about an expansion crack. Furthermore, even in the product, stress is centralized on the welded part owing to the inner load in use.

Therefore, in the UOE pipe production process, this peaking should be decreased as much as possible before the weld. For removing the peaking, a process utilizing edge-bending by a crimping press is considered. However, this process depends upon the bending moment $M_0=F\cdot L$ between two points F and F as shown in FIG. 2. In order to bend the vicinity of the edges ($L\rightarrow 0$), a load F obtaining the constant moment $M_0$ becomes infinite theoretically. Therefore 1.0 to 1.5 t (t=thickness) from the edge of the plate generally remains as non-processed, i.e., straight.

FIG. 3 shows the peaking after O-ing for a pipe which has been subjected to the edge-bending by means of a crimping press of 1500 t. It is noted that the higher becomes the peaking, the higher are the thickness and the strength of the pipe ("X65" and "X42" mean the strength grade of the pipe). Therefore, only using the crimping press is not enough to reduce the peaking.

As a method of reducing the peaking, the edge-bending process has been tried. According to this process, illustrated in FIG. 4, since the steel plate is effected with compressive stress in the circumferential direction at pressing by means of an upper die A and a lower die B, the peaking is more or less decreased during the compressing step. However the edge-bending by O-ing is a kind of buckling phenomena as shown in FIG. 4, and a distance L giving the moment between fulcra is small and the efficiency is inferior. Therefore, a great pressing load is required to reduce the peaking by O-ing. That is, for reducing the peaking on the steel pipe in conditions of API grade, X65, t/D>5% and 12 m length of the pipe, a pressing power of more than 60,000 or 70,000 t is required. But an apparatus generating such power is large scaled and difficult in view of the building, and besides is very expensive.

Based on these difficulties, a method has been considered whereby the O-shaped pipe-blank is, after O-ing but prior to welding, reduced in circumference by an up-set shrinker. This method reduces in diameter the O-shaped pipe-blank within a possible range from the outer face by means of the up-set shrinker in reverse to the expansion after the welding. In such a way, the vicinity of the butting edges is effected with edge-bending through compression in the circumferential direction, thereby to decrease the peaking. In a case of such a method, the diameter of the pipe is reduced in general by around 1 m.

However, since this method merely reduces the blankwork from the overall circumference by means of the shrinker dies surrounding the pipe, the mechanism of decreasing the peaking is not different in substance from the buckling phenomena by O-ing, due to which efficiency is not sufficient in reducing the peaking, and the extreme compression plastic deformation is imparted to the entire pipe for the purpose of reducing the peaking. As a result, the strength is lowered by the Bauschinger effect and the toughness is deteriorated by the plastic deformation.

It is an object of the invention to provide an up-set shrinker which is able to control the peaking to be at a minimum on the butted edges in the reducing process after the welding.

It is another object of the invention to provide an apparatus which is able to control the peaking considerably with a low forming load without imparting the extreme compression plastic deformation to the overall blankwork.

It is a further object of the invention to provide an apparatus which is able to carry out the process in accordance with the strength and the thickness of the material, thereby to reduce to a minimum the peaking for material of any strength and thickness.

It is a still further object of the invention to provide an apparatus which is able to greatly reduce the peaking of an O-shaped pipe-blank.

It is another object of the invention to provide an economical apparatus which is simple in structure and easy to manufacture.

SUMMARY OF THE INVENTION

For accomplishing the above mentioned objects, the up-set shrinker according to the invention is provided with a plurality of reducing shrinker dies located around an O-shaped pipe-blank in correspondence to parts of the pipe-blank other than butting parts of the edges of the pipe-blank. At least one edge of the processing shrinker die is located in correspondence to the butting parts of the edges of the pipe-blank. The edge processing shrinker die is formed at its die surface with a projecting portion over the length of the die, and is actuated independently of the reducing shrinker dies.

In a preferred embodiment, the projecting portion on the caliber of the edge processing shrinker die is reversed with respect to the curvature of said profiled die surface (reversed R) or is straight in cross section (see FIG. 9-A, FIG. 9-B), by means of which the butted edges of the pipe-blank are processed with push-bending.

According to the up-set shrinker of the invention, only the butted edges are effectively deformed to decrease the peaking without imparting extreme compressive plastic deformation to the remaining parts of the O-shaped pipe-blank.

DETAILED DESCRIPTION OF THE INVENTION

Figure 1:
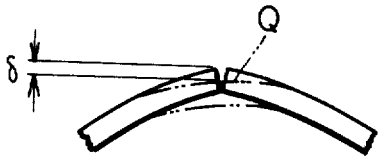
FIG. 1 is an explanatory view showing peaking on the butted part of the steel pipe.
Figure 2:
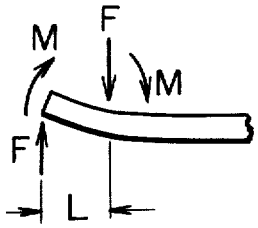
FIG. 2 PRIOR ART
FIG. 2 is an explanatory view showing in principle the edge-bending process for producing thick wall steel pipe.
Figure 3:
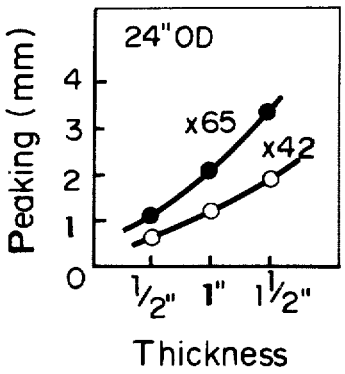
FIG. 3 is a graph showing the relation between thickness of the plate and the peaking amount when O-ing is carried out after the edge-bending process.
Figure 4:
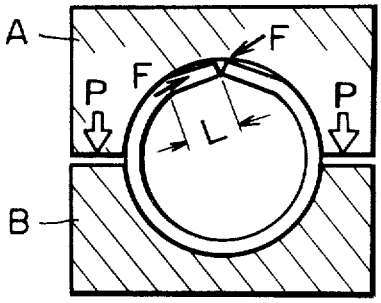
FIG. 4 PRIOR ART
FIG. 4 is an explanatory view showing in principle the edge-bending process by O-ing.

FIGS. 5–8 show the up-set shrinker of the invention and processing conditions for operation thereof. In these drawings, the numeral 1 is a pipe-blank to be O-shaped, 11, 11 are edges of the pipe-blank to be butted, and 2 is an up-set shrinker of the invention.

The up-set shrinker 2 includes an outer cylinder 3 fixed on a base (not shown), inner cylinder 4 disposed on an inner side of the outer cylinder 3 and shrinker dies 6, 6' projecting from a plurality of positions (e.g. 10 to 12 positions) in the circumferential direction of the inner surface of the cylinder 4. Proper fixing means of the outer cylinder 3 and others are secured with a plurality of the reducing cylinders 5, actuating rods of which are each connected to a plurality of positions in the circumferential direction at the rear end of the inner cylinder 4 which is slidable in the axial direction of the outer cylinder 3 by the actuation of the reducing cylinder 5.

Figure 5:
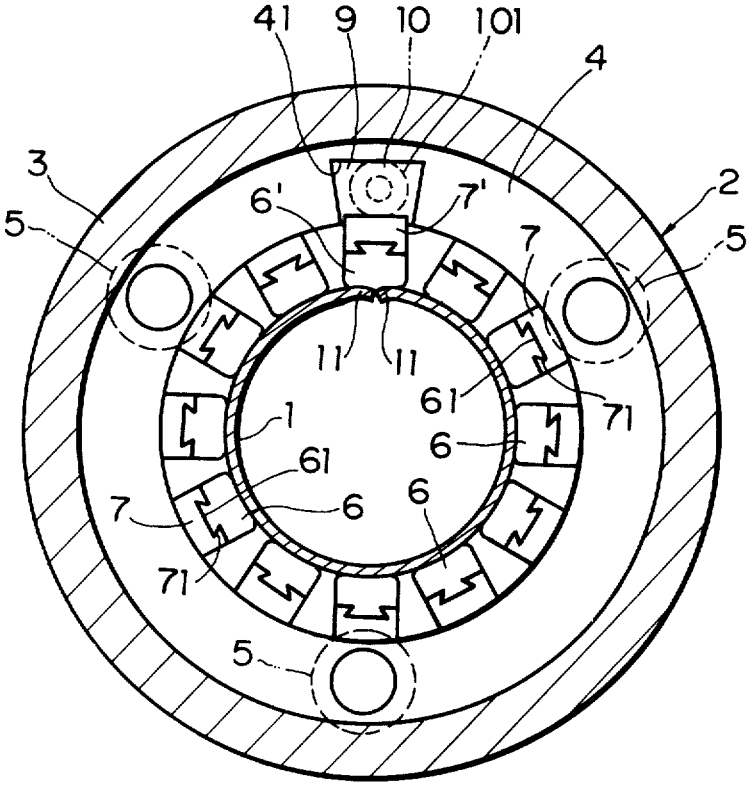
FIG. 5 is an explanatory view showing the up-set shrinker of the invention.

The shrinker dies 6, 6' are, as shown in FIG. 5, successively arranged in determined distance to surround O-shaped pipe-blank 1. The shrinker die 6' of the dies 6, 6' meeting the butting edge 11 does the force-bending process to this part, and the plurality of the shrinker dies 6 not meeting the butting edge 11 do the pipe-reducing. A profiled die surface 62 of the shrinker die 6 is constructed with a determined curvature to adapt to an outer curvature of the O-shaped pipe-blank 1, and is formed with gradient in length of its outer face (the attaching side to a taper segment 7) and is formed with a dovetail 61 on the gradient. The shrinker die 6 becomes, due to the gradient, thinner in thickness toward the rear side. See FIG. 6. On the other hand, the inner cylinder 4 is entirely or integrally projected with a plurality of taper segments 7 on its inner face. The taper segments are each formed with gradient in length of its inner face (the attaching side to the shrinker die 6) and formed with dovetail grooves 71 on the gradient. The taper segment 7 becomes, due to the gradient, thicker toward the rear side. Each of the shrinker dies 6 is supported in the inner cylinder 4 in that the dovetail 61 is fitted into the dovetail groove 71. The shrinker dies 6 are provided at their front and rear sides with supporters 15, 16 (FIG. 7) surrounding the O-shaped pipe-blank 1. The front supporter 16 of the shrinker die 6 is formed at its one side in the circumferential direction with a stopper 161 contacting end point of the shrinker dies 6, 6'. Accordingly, when the inner cylinder and the segment 7 are moved by the actuation of the reducing cylinder 5, the shrinker die 6 having contacted the stopper 161 changes itself centripetally of the inner cylinder 4 owing to the gradient of the dovetail groove 71 and the dovetail 61.

Figure 9A:
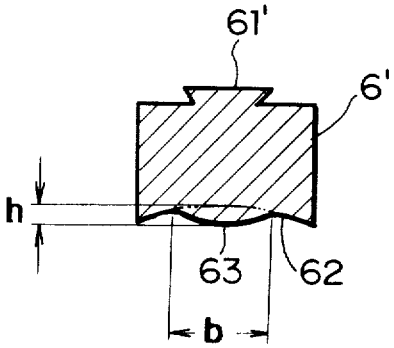

On the other hand, the shrinker die 6' meeting the butted edges 11, 11 of the O-shaped pipe-blank to forcedly bend these parts, is different in the profiled die surface shape from the reducing shrinker die 6, and is worked separately from working of the reducing shrinker die 6. That is, the edge processing shrinker die 6' is, as shown in FIG. 9A or FIG. 9-B, constructed with a projection or projecting area 63 or 631 which is of said reversed R or is linear, projecting on a die surface 62 assumed with a regular curvature. The structures for actuating the shrinker die 6' irrespectively of the actuation of the other shrinker die 6 is shown in FIG. 7 an FIG. 8.

Figure 7:
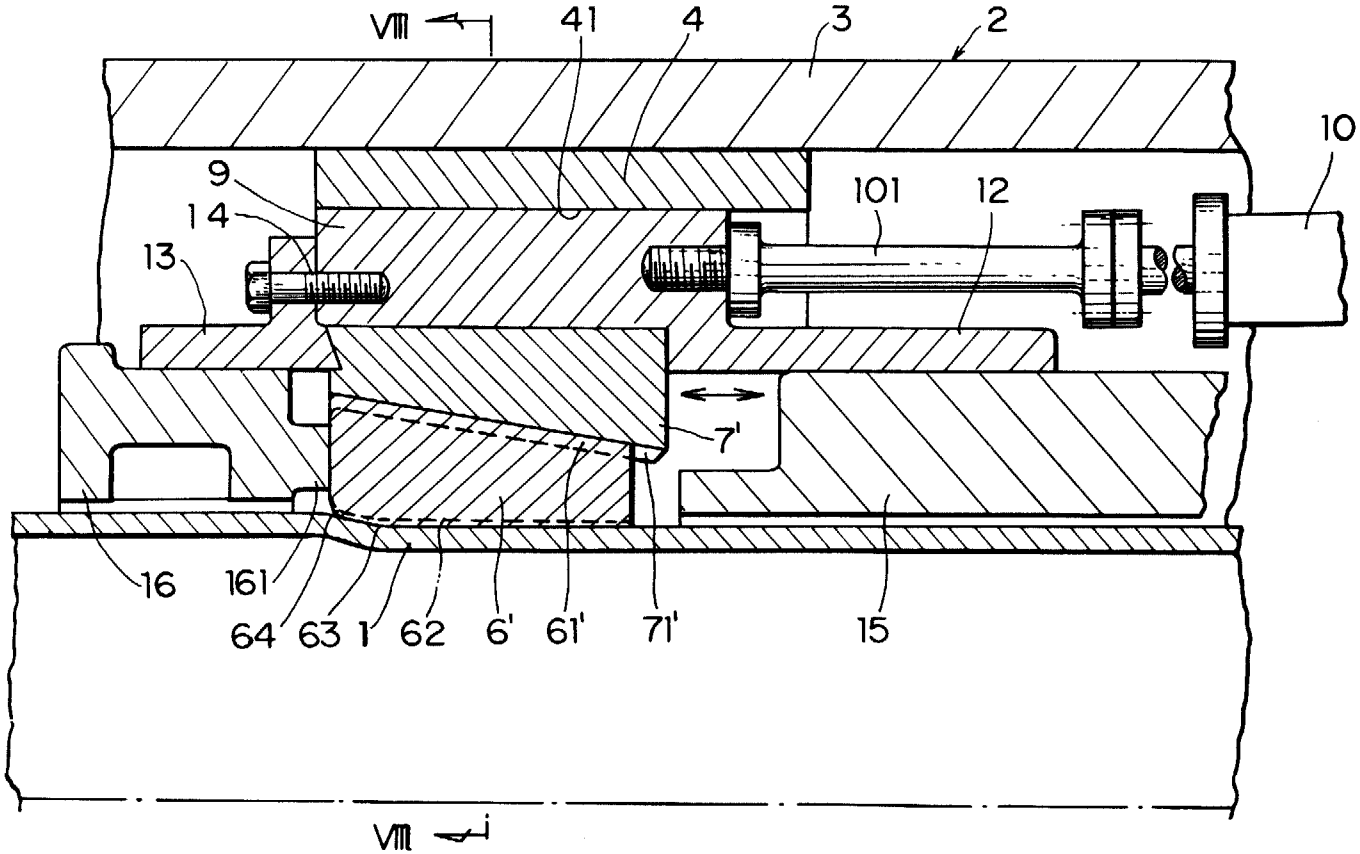
FIG. 7 is a vertical cross sectional view showing the edge-processing shrinker die of the up-set shrinker, and a processing condition thereby.
Figure 8:
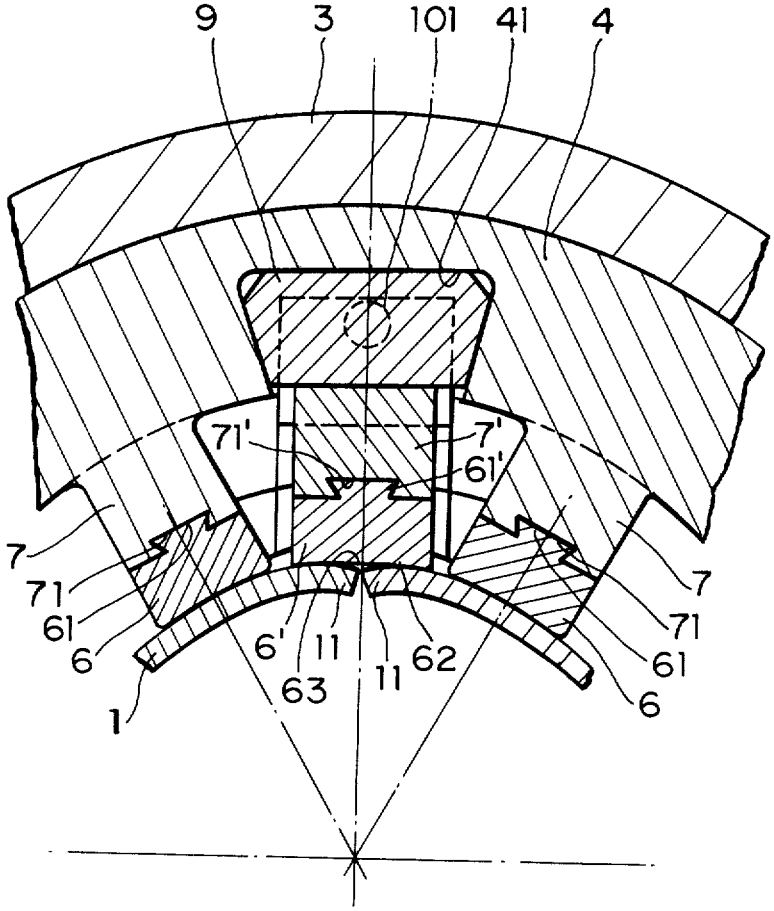
FIG. 8 is a cross sectional view along the line VIII—VIII in FIG. 7, FIG. 9-A and FIG. 9-B are cross sectional views of the edge-processing shrinker die of the invention.

Referring to FIGS. 7 and 8, the inner cylinder 4 is partially formed with a guide groove 41 in the axial direction thereof, into which a sliding block 9 is slidably inserted. The sliding block 9 is connected at its rear side to an actuating rod 101 of the edge processing cylinder 10 secured to the outer cylinder 3 via proper securing means, and is fixed in its inner side with a taper segment 7'. The structure of causing the taper segment 7' to support the shrinker die 6' is the same as the case of the taper segment 7 and the shrinker die 6. That is, the taper segment 7' has a gradient on its inner surface along the length thereof the same as is formed with the dovetail groove 71' in its gradient face. The edge processing shrinker die 6' has a gradient on its inner surface in the length thereof the same as is formed with dovetail 61' in its gradient face. The shrinker die 6' is supported in a condition that its projects within the inner cylinder 4 with the dovetail 61' fitted in the dovetail groove 71'. Accordingly, when the sliding block 9 and the taper segment 7' are moved towards the supporter 16 by the actuation of the edge processing cylinder 10, the shrinker die 6' having contacted the stopper 161 biasses itself centripetally of the inner cylinder 4 owing to the gradient of the dovetail groove 71' and the dovetail 61'.

In order to smoothly change the shrinker die 6' centripetally of the inner cylinder 4, a guide plate 12 is elongated in the length of the sliding block 9 which is fixed in the length thereof with another guide plate 13 with a bolt 14. Thus, the guide plates 12, 13 are slid along the surfaces of the supporters 15, 16 surrounding the O-shaped pipe-blank 1.

The projecting portion 63 on the shrinker die 6' should be constructed paying attention to following points. Namely, the height h of the profiled die surface 62 and the width b of the projection should be determined, taking the thickness and the strength of the steel plate into consideration, in order that the butted edges 11, 11 have the determined curvature after the pipe-blank is effected with spring back after the processing. The top of the projection and its both sides are continued with a smooth curve line. The shrinker dies 6, 6' are formed at lower ends 64 with moderate R so as to avoid flaws between the processed part and the non-processed part of the O-shaped pipe-blank.

A further reference will be made to the processing by the above mentioned up-set shrinker 2 in detail.

The up-set shrinker 2 according to the invention reduces the diameter of the O-shaped pipe-blank by means of the plurality of the shrinker dies 6 as well as forcedly bending the butted edges by means of the shrinker dies 6'. At first, only the reduction by the shrinker dies 6 is referred to. O-shaped pipe-blank rounded within the possible range by O-ing, is sent to the inner cylinder 4 by means of a not sown sending means, and in this condition the reducing cylinders 5 are actuated. In such a manner, the inner cylinder 4 is slid toward the supporting bed 16 within the outer cylinder 3 so that the plurality of the taper segments 7 provided in the circumferential direction of the inner cylinder 4 also move. By moving of the taper segment 7, the reducing shrinker die 6 which is slidably inserted in the segment 7 and contacts the stopper 161 at its end, biases itself in the centripetal direction of the inner cylinder 4, due to the gradient formed with the taper segment 7 and said contacting of the end to the stopper 161, thereby to reduce the circumference shown with the phantom line on the profiled die surface of the shrinker die 6. Therefore, the O-shaped pipe-blank 1 is reduced in diameter by the compression force in the circumferential direction through the outer pressure of the shrinker die 6. If the reducing cylinder 5 is actuated after the reducing process to reversely advance the inner cylinder 4, the O-shaped pipe-blank is moved in by determined distance so that a subsequent non-reduced part of the pipe may be positioned to meet the shrinker die 6. The shrinker die 6 is moved in the centripetal direction of the inner cylinder 4 by the reducing cylinder 5 after moving the O-shaped pipe-blank, and subsequently by repeating such actions the reduction may be carried out all over the full length of the pipe-blank 1.

A next reference will be made to the processing of the forced bending on the butted edges by means of the shrinker die 6'. The edge processing cylinder 10 is actuated independently of the reducing cylinder 5 under the condition that the O-shaped pipe-blank 1 is sent to the inner cylinder 4. Thus, the sliding block 9 moves toward the supporter 16 (from the right to the left in FIG. 6) in spite of duration of moving of the inner cylinder 4 so that the taper segment 7' also moves in the same direction by the same amount. By this moving of the taper segment 7', the edge processing shrinker die 6' slidably inserted in the dovetail groove 71' of the taper segment 7' changes to the centripetal direction of the inner cylinder 4 similarly to the reducing shrinker die 6 by the gradient and the action of the stopper 161. As mentioned above, the profiled die surface 62 of the edge processing shrinker die 6' has a projecting portion 63 reverse to the curvature of the profiled die surface. As a result of moving the shrinker die 6', the butted edges 11, 11 of the O-shaped pipe-blank 1 are, as shown in FIG. 8, subject to a bending moment. The butted edges 11, 11 are deformed by being curled inwardly by said bending moment, and subsequently recover to the determined curvature by the spring back caused at releasing of the pressure. Such a process is very efficient because it is not performed by the O-ing nor the buckling phenomena by the force transmitted in the circumferential direction of the pipe such as a mere reducing process.

The apparatus of the invention carries out the reducing process on the O-shaped pipe-blank by means of the shrinker dies 6, and carries out the forced bending process on the butted edges 11, 11 by means of the shrinker dies 6'. There are two actual embodiments for carrying out these two processes. One of them is that the overall circumference of the O-shaped pipe-blank 1 including the butted edges 11, 11 is at once reduced by means of the reducing cylinder 5, the edge processing cylinder 10 and shrinker dies 6, 6', and the butted edges are forcedly bent concurrently. The other embodiment is that after reducing by means of the reducing cylinder 5 and the shrinker die 6, the edge processing cylinder 10 is solely actuated to carry out the forced bending on the butted edges 11, 11 only by the shrinker die 6'.

The former is when the edge processing cylinder 10 is actuated at the same time as the actuation of the reducing cylinder 5 to move the taper segments 7, 7', thereby to move the up-set shrinkers 6, 6' in the centripetal direction of the inner cylinder 4 simultaneously and by the same amount.

However, in this process, the butted edges 11, 11 may project, depending upon the strength and the thickness of the O-shaped pipe-blank. In such a case the stroke of the edge processing cylinder 10 is further increased so that the reducing cylinder 5 and the edge processing cylinder 10 are actuated simultaneously, in order to increase the biassing amount of the shrinker die 6' in the centripetal direction of the inner cylinder 4. Thereby the forcing amount of the projection 63 against the butted edges 11, 11 is increased so that the butted edges 11 are exactly deformed to decrease the peaking amount to the minimum.

On the other hand, depending upon the strength and the thickness of the material, disadvantageous peakings will be caused by operating the processes concurrently. For such a case, the latter method is employed. That is, in the case of causing the disadvantageous peaking, the edge processing cylinder 10 is worked not at the same time but after the reducing cylinder 5. Thus, the sliding block 9 moves within the inner cylinder 4 while the cylinder 4 is kept still, so that the edge processing shrinker die 6' is biased in the centripetal direction of the inner cylinder 4 via the taper segment 7' and the butting edges 11, 11 are compressed by the projection 63. At this time, there is not caused the reducing action by the reducing shrinker die 6, i.e., the compressive buckling action, and the push-deforming force effectively acts on the butted edges 11, 11 only. Then, if controlling the stroke of the edge processing cylinder 10, the biassing amount of the shrinker die 6' in the centripetal direction of the inner cylinder 4 is changed, thereby changing the forcing amount of the butted edges, thus controlling the forcing amount by controlling the stroke of the cylinder 10 such that the peaking amount is not made disadvantageous.

The edge processing shrinker die 6' is independent of the other dies, and is detachable and attachable with respect to the taper segment 7'. Therefore, in addition to the actuating timing and the selection of the stroke amount of the cylinders 5, 10, shrinker dies 6' of different kinds in height of the projection are appropriately selected, thereby to also enable to control said forcing amount and the peaking amount.

In the present embodiment, when the O-shaped pipe-blank 1 is processed over the length thereof, the pipe-blank is moved successively, but reversely. The up-set shrinker 2 itself may be moved together with its base along the length of the pipe-blank 1 which is secured.

The pipeblank processed as mentioned above is subjected to tack welding at the butted edges 11, 11 and further to seam welding on the inner and outer surfaces, and is expanded by means of an expander to produce a final product.

The pipe-making facility incorporating the present invention is not limited to the UOE process. That is, the invention may be applied to all pipe-making facilities in which O-shaped pipe-blanks are produced.

The O-shaped pipe-blank used with the inventive apparatus is a pipe-blank which has been passed through the O-ing, that is, the material has been rounded within the possible range by means of an O-press. It is not necessary to use perfectly O-shaped material only. This fact will be seen from the aforementioned description concerning difficulties of carrying out the O-forming on the thick steel plate the O-ing.

EXAMPLE 1

For producing thick wall steel pipes from steel plates of 24 inches in diameter, four thicknesses (0.5, 1, 1.5, 2 in) and grades of X42 and X65, the thick plates were subjected to U-ing and O-ing in the possible range, and the O-shaped pipe-blanks were, as shown in in FIGS. 5–9A, processed by means of the up-set shrinker of the present invention provided with the reducing shrinker dies and the edge processing shrinker dies having the projecting portion of the reverse R on the profiled die surface thereof. In order to compare with the inventive process, the reducing process was practiced by means of the up-set shrinker provided with the shrinker die only.

Figure 10:
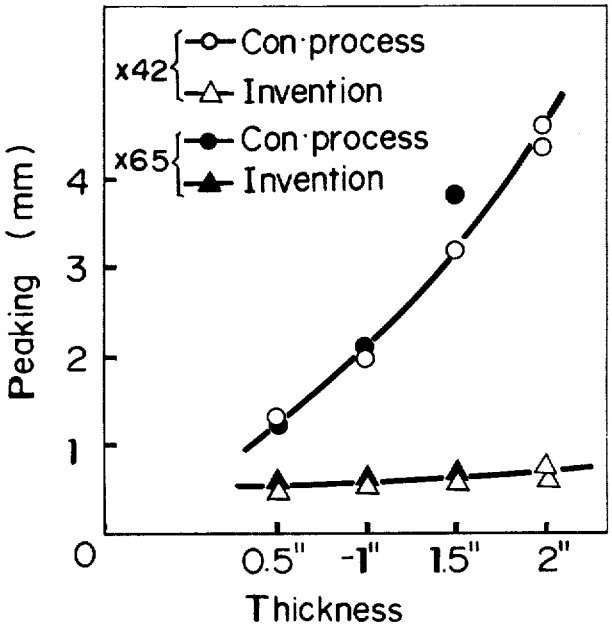
FIG. 10 is a graph showing a comparison of the reducing effect by the up-set shrinker die of the present invention with that of the existing up-set shrinker.

FIG. 10 shows the reduced peaking obtained by the above processes, that is, the peaking amount can be remarkably decreased by the inventive apparatus having the shrinker dies with the projecting portions of the reverse R on the profiled die surface thereof.

EXAMPLE 2

For producing thick wall steel pipe from steel plate of 24 inches in diameter, 1.5 in in thickness and grade of X65, the plate was subjected to the processings by changing the forcing amount (L) of the shrinker dies having the projecting portions on the profiled die surface to the butted edges.

Figure 11:
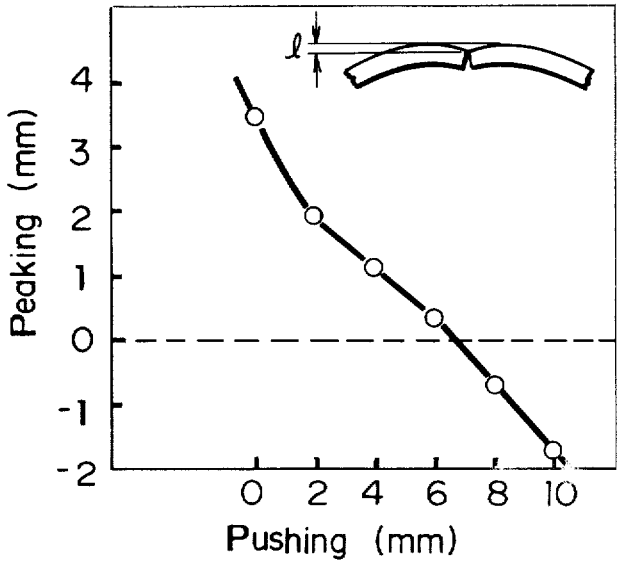
FIG. 11 is a graph showing changes of the peaking amount when changing the amount of force applied to the butted edges by the edge-processing shrinker die of the up-set shrinker of the invention.

FIG. 11 shows the relation between the forcing amount and the peaking amount. As is seen, the peaking amount is reduced by increasing the forcing amount (L) of the shrinker die, but if it is too much, a negative peaking is caused even after the spring back. However, since the present invention has the edge processing cylinders independent of the reducing cylinders, thick wall steel pipe may be produced with excellent shape only by appropriately controlling the forcing amount of the shrinker die by the edge processing cylinder.

For carrying out the above mentioned tests, the width of the projecting portion was changed between 80 mm and 200 mm, but influences thereby to the peaking amounts were little.

Figure 9B:
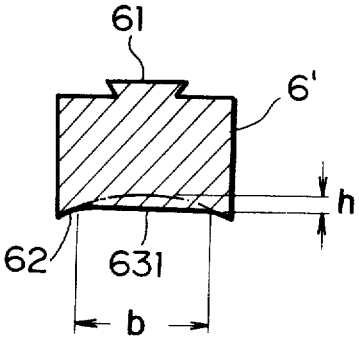
Figure 6:
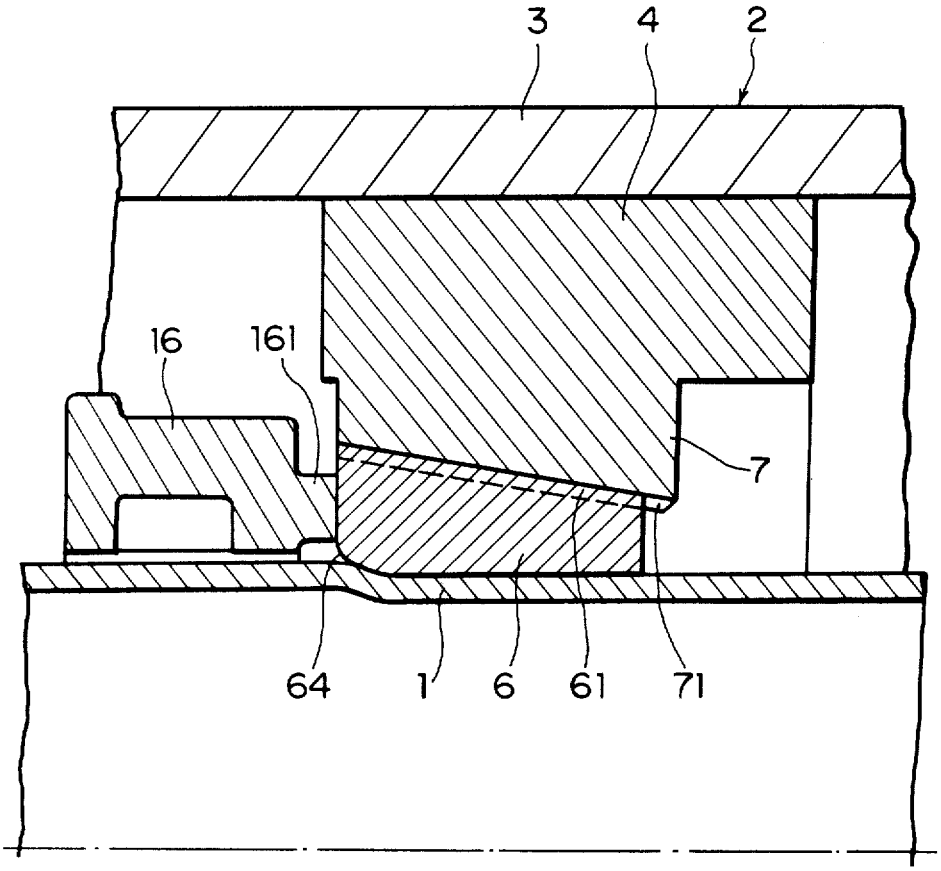
FIG. 6 is a vertical cross sectional view showing the reducing shrinker die of the up-set shrinker, and a processing condition thereby.

The above examples use projecting portions of the reversed R as shown in FIG. 9-A as the edge processing shrinker die but an edge processing shrinker die having a straight projecting portion on its profiled die surface as shown in FIG. 9B is basically the same in working and resulted effect.

We claim:

1. In an apparatus for producing thick wall steel pipe of generally O-shape, and having butting edges, and inner and outer surfaces, comprising:

an up-set shrinker having an outer cylinder (3) fixed to a base; an inner cylinder (4) disposed on an inner side of said outer cylinder (3); at least one reducing cylinder (5) coupled at least to said inner cylinder (4), said inner cylinder (4) being slidable axially of said outer cylinder (3) by means of said at least one reducing cylinder (5); said inner cylinder (4) having a guide groove (41) on one part of the inner surface thereof along its axial direction; a sliding block (9) mounted in said guide groove (41); an edge processing shrinker die (6') mounted to and held by said sliding block (9); and an edge processing cylinder (10) coupled to said sliding block (9), said sliding block (9) being slidable within said guide groove (41) by means of said edge processing cylinder (10);

the improvement wherein:

said inner cylinder (4) includes a plurality of taper segments (7) projecting from the inner surface of said inner cylinder centripetally thereof;

a plurality of reducing shrinker dies (6) for shaping parts of the O-shaped pipe other than edge butting portions of the O-shaped pipe, each reducing shrinker die (6) being slidably held by a respective one of said taper segments (7) via a mating dovetail (61) and a dovetail groove (71) and being non-rotatable;

a stopper member (161) is provided for restraining respective ends of said reducing shrinker dies (6);

said slidable block (9) includes a further taper segment (7') projecting inwardly centripetally thereof;

said edge processing shrinker die (6') being provided with a forming surface configured to bear against and shape outer surfaces of the edge butting portions of the O-shaped pipe, without being interposed between the butting edges of the O-shaped pipe, said edge processing shrinker die (6') being slidably mounted to said further taper segment (7') via a mating dovetail (61') and a dovetail groove (71') and being non-rotatable;

a further stopper member (16) for restraining an end of said edge processing shrinker die (6'); and said forming surface of said edge processing shrinker die (6') having a surface which faces interior of said inner cylinder (4), and a cavity defined over the full length of said surface thereof which faces the interior of said inner cylinder (4), and a projecting area

(63) on said cavity (62) and extending over the full length of said edge processing shrinker die (6');

said plurality of reducing shrinker dies (6) being displaceable centripetally of said inner cylinder (4) by sliding of said inner cylinder (4) in said outer cylinder (3) by means of said reducing cylinder (5), and said edge processing shrinker die (6') being displaceable centripetally within said guide groove (41) by sliding of said sliding block (9) by means of said edge processing cylinder (10); and wherein no inner die is provided at least in the vicinity of said reducing shrinker dies (6) so that no contact is made to the inner surface of the generally O-shaped pipe-blank in the vicinity of said reducing shrinker dies, no inner die is provided opposite said edge processing shrinker die (6') so that no contact is made to the inner surface of the generally O-shaped pipe-blank in the vicinity of said edge processing shrinker die.

2. The apparatus of claim 1, wherein the projecting area on said edge proecessing shrinker die has a cross-sectional curvature which is the reverse of the cross-sectional curvature of said cavity thereon.

3. The apparatus of claim 1, wherein the projecting area on said edge processing shrinker die is straight in cross-section.

4. The apparatus of claim 1, wherein the projecting area has a moderate curvature between its top and both sides thereof.

5. The apparatus of claim 1, wherein said reducing shrinker dies each have a gradient tangential with the gradient of the respective taper segments; and comprising means for biasing said reducing shrinker dies in the centripetal direction of said inner cylinder.

6. The apparatus of claim 5, wherein surfaces defining the gradients of said reducing shrinker dies each have a said dovetail (61) and the surfaces defining the gradients of the taper segments each have a said dovetail groove (71).

7. The apparatus of claim 5, wherein said stopper member (161) comprises a support fixed on a front side of said reducing shrinker dies and which surrounds the O-shaped pipe-blank.

* * * * *